US006590339B2

(12) United States Patent
Yoo

(10) Patent No.: US 6,590,339 B2
(45) Date of Patent: Jul. 8, 2003

(54) PLASMA DISPLAY PANEL

(75) Inventor: Min-sun Yoo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 175 days.

(21) Appl. No.: 09/780,621

(22) Filed: Feb. 12, 2001

(65) Prior Publication Data

US 2001/0026131 A1 Oct. 4, 2001

(30) Foreign Application Priority Data

Feb. 11, 2000 (KR) ..... 2000-6536

(51) Int. Cl.[7] ..... H01J 29/10

(52) U.S. Cl. ..... 313/587; 313/586; 313/582; 313/495; 313/505

(58) Field of Search ..... 313/582, 585, 313/586, 587, 495

(56) References Cited

U.S. PATENT DOCUMENTS 6,259,212 B1 * 7/2001 Song ..... 315/169.4
6,288,483 B1 * 9/2001 Haven et al. ..... 313/461
6,384,531 B1 * 5/2002 Park et al. ..... 313/584
6,411,033 B1 * 6/2002 Mori et al. ..... 313/582
6,433,477 B1 * 8/2002 Ha et al. ..... 313/586
6,437,505 B1 * 8/2002 Baret et al. ..... 313/582

* cited by examiner

*Primary Examiner*—Sandra O'Shea
*Assistant Examiner*—Anabel Ton
(74) *Attorney, Agent, or Firm*—Staas & Halsey LLP

(57) ABSTRACT

A plasma display panel includes first and second substrates facing each other and separated by a predetermined distance from each other, a plurality of address electrodes formed on a lower surface of the first substrate in a predetermined pattern, a first dielectric layer covering the address electrodes, a plurality of maintaining electrodes, each including first and second electrodes, formed on an upper surface of the second substrate at a predetermined angle with respect to the address electrodes of the first substrate, a plurality of black matrixes discontinuously formed between the maintaining electrodes in an alternating pattern one by one, a second dielectric layer formed on the second substrate covering the maintaining electrodes and the black matrixes, a plurality of partitions formed between the first and second substrates and defining discharge spaces therebetween, and red, green and blue fluorescent layers coated in the discharge spaces defined by the partitions. Thus, since the discontinued portions are formed at the black matrixes, which in turn are formed on the second substrate, the NA of any desired (particularly B) fluorescent layer area is increased so that the lowering of the light emission brightness of that particular fluorescent layer can be prevented. Therefore, the white balance property of an image can be improved.

11 Claims, 6 Drawing Sheets

PLASMA DISPLAY PANEL

CROSS-REFERENCE TO RELATED APPLICATIONS

This application claims the benefit of Korean Application No. 00-6536, filed Feb. 11, 2000, in the Korean Patent Office, the disclosure of which is incorporated herein by reference.

BACKGROUND OF THE INVENTION

1. Field of the Invention

The present invention relates to a plasma display panel, and more particularly, to a plasma display panel in which a black matrix pattern formed on a front substrate is improved.

2. Description of the Related Art

A typical plasma display panel is widely noted for its display performance in a display capacity, brightness, contrast and a viewing angle, as a superior flat panel display device having performance close to a cathode ray tube. The plasma display panel can be classified into either a direct current plasma panel or an alternating current plasma panel according to the operational principles thereof. Also, the plasma display panel can be classified into either a facing discharge type plasma display panel or a surface discharge type plasma display panel.

FIG. 1 shows an example of a conventional surface discharge type plasma display panel. As shown in the drawing, a plasma display panel 10 includes a rear substrate 11, address electrodes 12 formed on the rear substrate 11, a dielectric layer 13 formed on the rear substrate 11 covering the address electrodes 12, partitions 14 formed on the dielectric layer 13 to maintain a discharge distance and prevent electrical and optical cross talk between cells, and a front substrate 17 facing the rear substrate 11 and on the bottom surface thereof pairs of maintaining electrodes 15 and 16 are formed in a direction perpendicular to the address electrodes 12. A black matrix 18 is formed between each pair of maintaining electrodes 15 and 16. A dielectric layer 19 is formed on the same surface of the front substrate 17 that the maintaining electrodes 15 and 16 and the black matrixes 18 are formed and the protective layer 21 is formed or the dielectric layer 19.

Red (R), green (G) and blue (B) fluorescent layers are formed on the side surfaces and the bottom surface of respective discharge spaces defined by the partitions 14. The discharge spaces are filled with a discharge gas which is a mixture of Ne and Xe.

The driving of the plasma display panel having the above structure can be classified into driving for an address discharge and driving for a maintaining discharge. The address discharge is generated between the address electrode 12 and one maintaining electrode 15, and when this occurs, wall charges are formed on the maintaining electrode 15. The maintaining discharge is generated between the maintaining electrode 15 where the wall charges are formed and another maintaining electrode 16. The maintaining discharge is a main discharge for displaying an actual image. That is, R, G and B fluorescent layers selected by a selective maintaining discharge are excited to form an image.

However, in the plasma display panel, brightness of lights emitted from the R, G and B fluorescent layers are not congruous while performing under the same conditions. That is, the light emitting brightness of the B fluorescent layer is relatively lower than those of the R and G fluorescent layers. Thus, a white balance property deteriorates when a color image is realized by using the plasma display panel.

To solve the above problem, a method has been proposed in which the coating area of the B fluorescent layer is formed larger than that of the R and G fluorescent layers or the B fluorescent layer is coated relatively thicker. However, since this method requires the interval between the partitions where the B fluorescent layer is coated to be made different, the method is not appropriate for mass production.

SUMMARY OF THE INVENTION

Accordingly, it is an object of the present invention to provide a plasma display panel in which the NA (numerical aperture) of the B fluorescent layer is increased so that the white balance property is improved during realization of a color image.

Additional objects and advantages of the invention will be set forth in part in the description which follows, and, in part, will be obvious from the description, or may be learned by practice of the invention.

Accordingly, to achieve the above and other objectives, there is provided a plasma display panel which comprises first and second substrates coupled to face each other and separated by a predetermined distance from each other, a plurality of address electrodes formed on a lower surface of the first substrate in a predetermined pattern, a first dielectric layer covering the address electrodes, a plurality of maintaining electrodes, each including first and second electrodes, formed on an upper surface of the second substrate at a predetermined angle with respect to the address electrodes of the first substrate, a plurality of black matrixes discontinuously formed between the maintaining electrodes in an alternating pattern therewith one by one, a second dielectric layer formed on the second substrate covering the maintaining electrodes and the black matrixes, a plurality of partitions formed between the first and second substrates defining discharge spaces, and red, green and blue fluorescent layers respectively coated in the discharge spaces defined by the partitions.

The foregoing and other objects of the present invention are further achieved by forming the first dielectric layer between the partitions.

The foregoing and other objects of the present invention are further achieved by forming the first and second electrodes of the maintaining electrodes a predetermined distance from each other and also forming each of the first and second electrodes of metal containing at least two lines.

The foregoing and other objects of the present invention are further achieved by forming the black matrixes such that a portion corresponding to a fluorescent layer having a relatively low brightness among the red, green and blue fluorescent layers is discontinued.

The foregoing and other objects of the present invention are further achieved by forming the black matrixes such than a portion corresponding to a flourescent layer having a relatively low brightness among the red, green and blue flourescent layers is discontinued, and further such that the fluorescent layer corresponding to the discontinued portion is the blue fluorescent layer.

BRIEF DESCRIPTION OF THE DRAWINGS

The above objects and advantages of the present invention will become apparent and more readily appreciated from the following description of the preferred embodiments taken in conjunction with the accompanying drawings of which.

DETAILED DESCRIPTION

Figure 1:
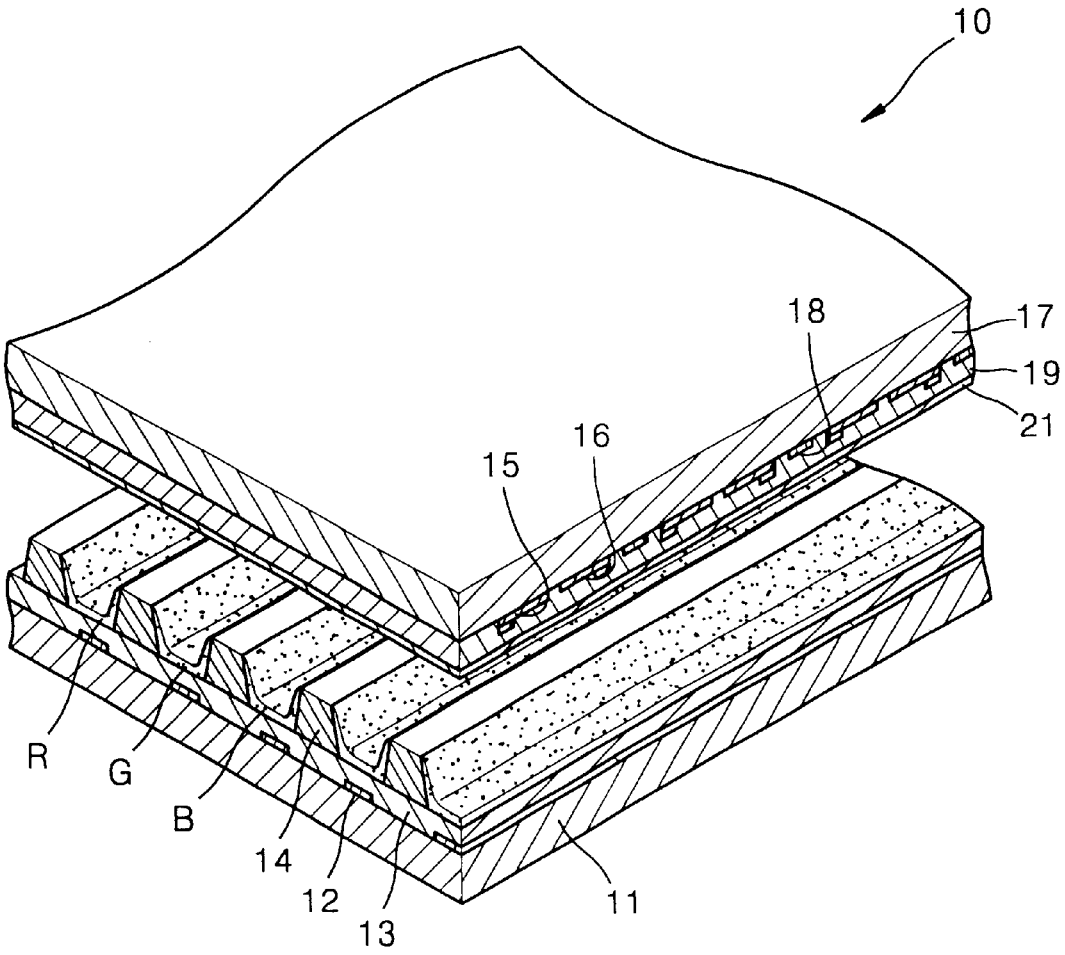
FIG. 1 (PRIOR ART)
FIG. 1 is an exploded perspective view of the conventional plasma display panel.

Reference will now be made in detail to the present preferred embodiments of the present invention, examples of which are illustrated in the accompanying drawings, wherein like reference numerals refer to like elements throughout.

Figure 2:
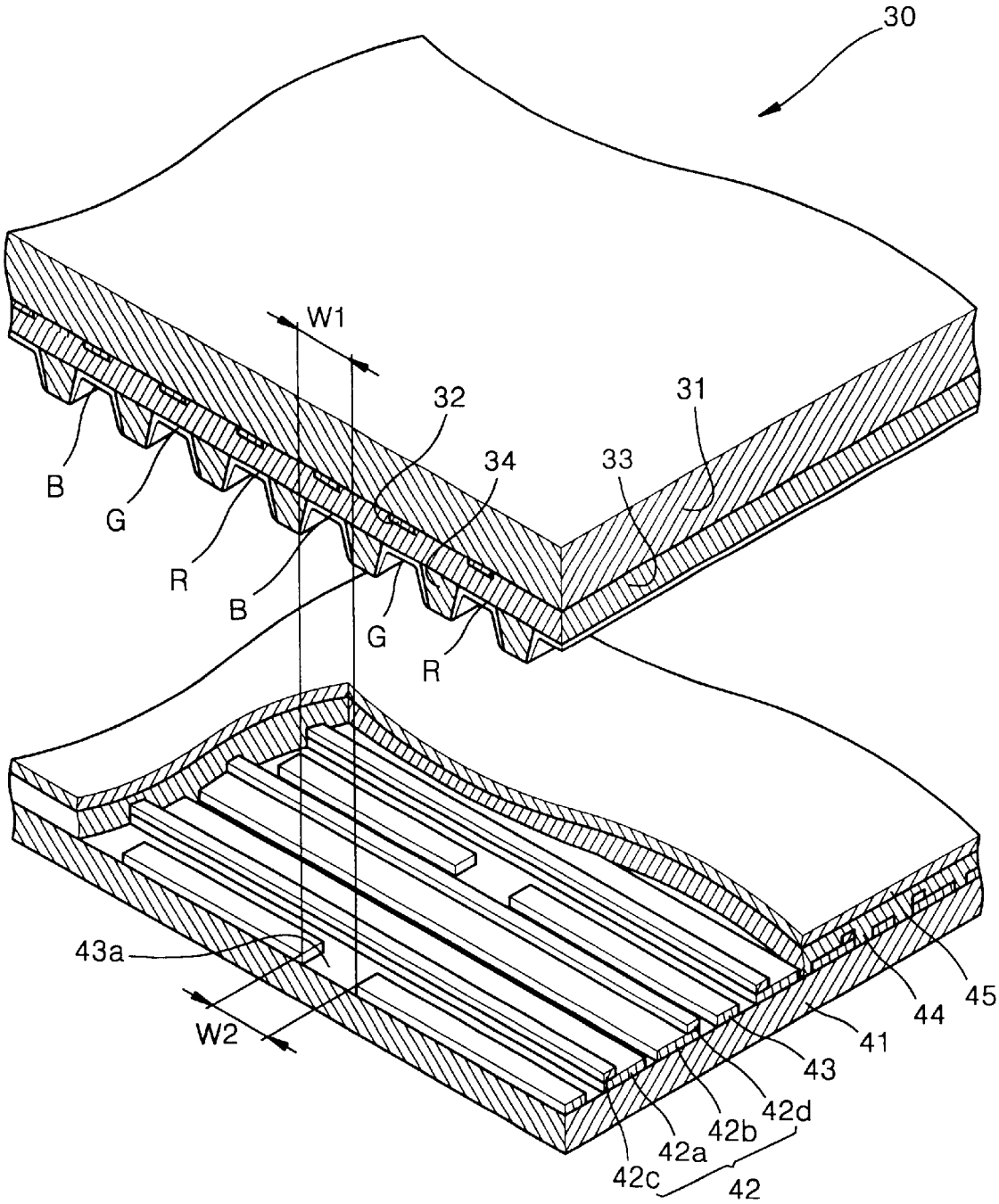
FIG. 2 is an exploded perspective view of a plasma display panel according to an embodiment of the present invention.

Referring to FIG. 2, a plasma display panel 30 according to a first embodiment of the present invention includes a first substrate 31, a plurality of address electrodes 32 formed on the lower surface of the first substrate 31 in a predetermined pattern, and a first dielectric layer 33 formed on the first substrate 31 and covering the address electrodes 32. The address electrodes 32 having predetermined widths are formed of strips that are parallel to each other. Partitions 34 partially defining discharge spaces therebetween are formed on the first dielectric layer 33 between and in alternating patterns with the address electrodes 32 one by one, and in a direction parallel to the address electrodes 32. Red (R), green (G) and blue (B) fluorescent layers are formed on the side surfaces of the partitions 34 and the bottom surface between the partitions 34.

The first substrate 31 is coupled to a transparent second substrate 41 forming a seal. A plurality of maintaining electrodes 42 each including a pair of first and second electrodes 42*a* and 42*b* are formed on the upper surface of the second substrate 41 in a direction perpendicular to the address electrodes 32. The first and second electrodes 42*a* and 42*b* are formed of transparent indium tin oxide (ITO), and bus electrodes 42*c* and 42*d* are formed along the first and second electrodes 42*a* and 42*b* to reduce line resistance thereof. The bus electrodes 42*c* and 42*d* may be formed of metal such as silver, silver alloy or aluminum and have widths much narrower than the widths of the first and second electrodes 42*a* and 42*b*.

Figure 3:
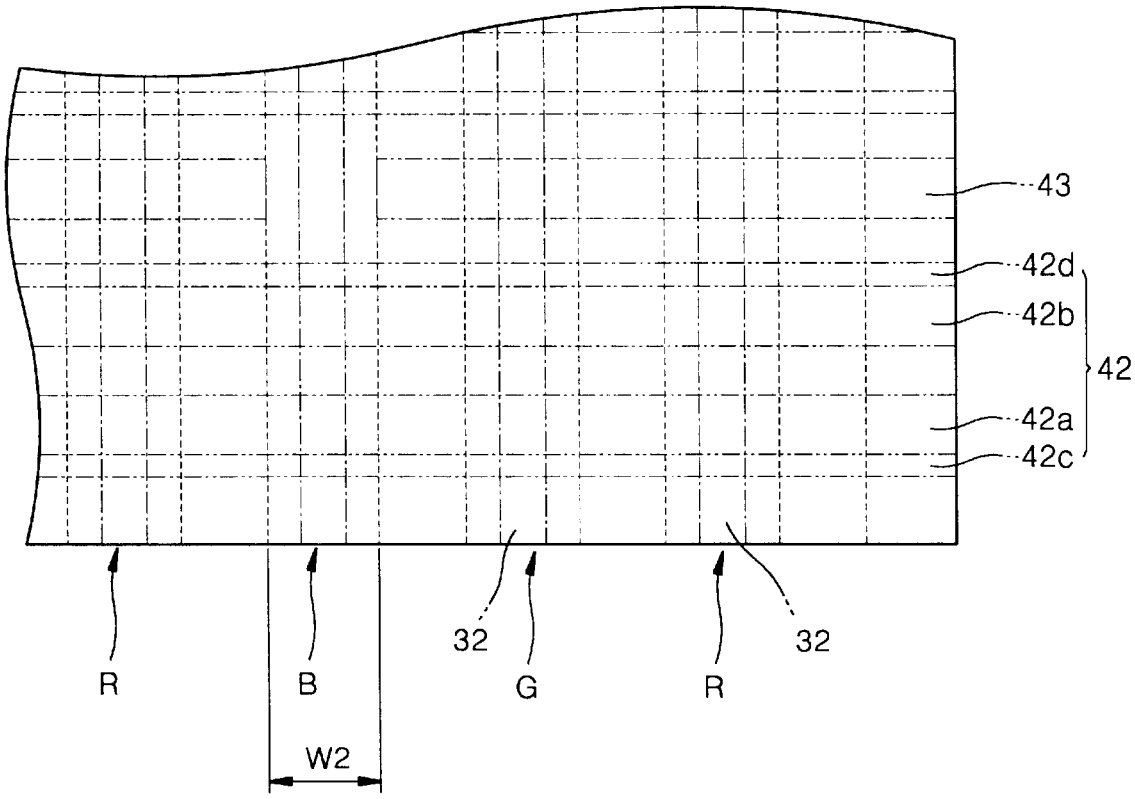
FIG. 3 is a plan view showing the formation of a black matrix in the plasma display panel of FIG. 2.

Black matrix 43 is formed between each pair of the maintaining electrodes 42. The black matrix 43 is formed in a discontinuous pattern so that a portion corresponding to the B fluorescent layer can be discontinued, as shown in FIGS. 2 and 3. Note that the discontinuous pattern may be formed to correspond with any of the other flourescent layers having different colors than blue, if desired. Here, the discontinued portion 43*a* is preferably formed to have the same width W2 as a width W1 of the B fluorescent layer. Note that the black matrix 43 is not necessarily black, but rather may be a color that can be changed within a range not affecting a white balance property. For example, the black matrix 43 may be formed to be blue.

A second dielectric layer 44 is formed on the upper surface of the second substrate 41 so that the maintaining electrodes 42 and the black matrixes 43 can be covered therein. A protective layer 45 formed of MgO (magnesium oxide) is formed on the upper surface of the second dielectric layer 44. The discharge spaces defined by the partitions 34 and the first and second substrates 31 and 41 are filled with a discharge gas which may include Ne and Xe.

Figure 4:
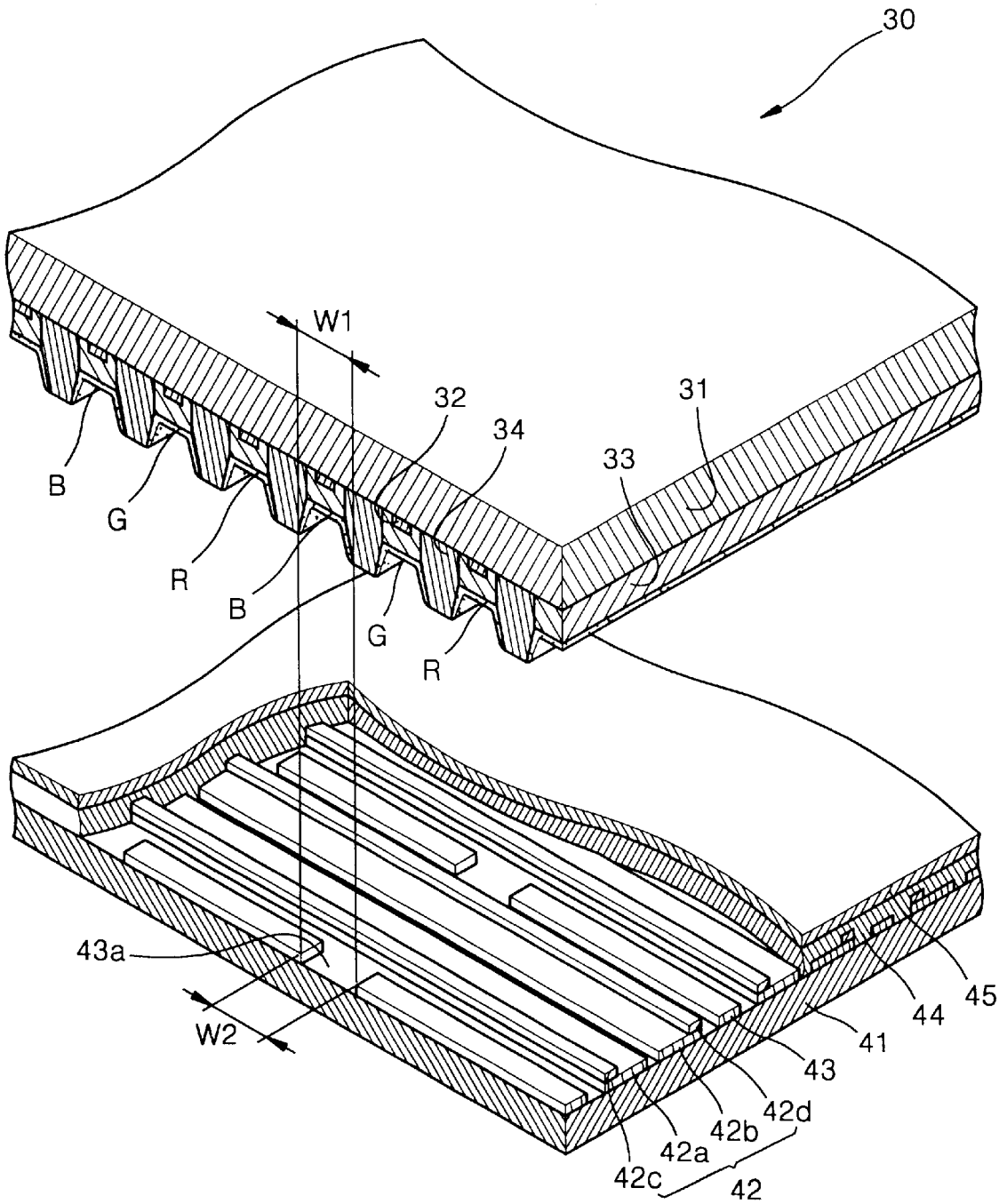
FIG. 4 is an exploded perspective view of a plasma display panel according to another embodiment of the present invention.

FIG. 4 shows a plasma display panel according to another embodiment of the present invention. Here, the same elements having the same functions as those shown in FIG. 2 are indicated by using the same reference numerals.

Referring to FIG. 4, in a plasma display panel according to a second embodiment of the present invention, a plurality of address electrodes 32 each having a predetermined width are formed in strips and parallel to one another on the lower surface of the first substrate 31. A plurality of partitions 34, partially defining discharge spaces and positioned in parallel to the address electrodes 32, are also formed such that each partition 34 is disposed between the address electrodes 32, such that the partitions 34 and the address electrodes 32 may be alternately patterned. The first dielectric layer 33, which covers the address electrodes 32, is formed over the address electrodes 32 and between the partitions 34. Red, green and blue fluorescent layers R, G and B are respectively coated on the side surfaces of the partitions 34 and over the first dielectric layer 33 between the partitions 34. Descriptions about elements of a second substrate 41 coupled to the first substrate are omitted since they are substantially the same as those of the plasma display panel illustrated in FIG. 2.

Figure 5:
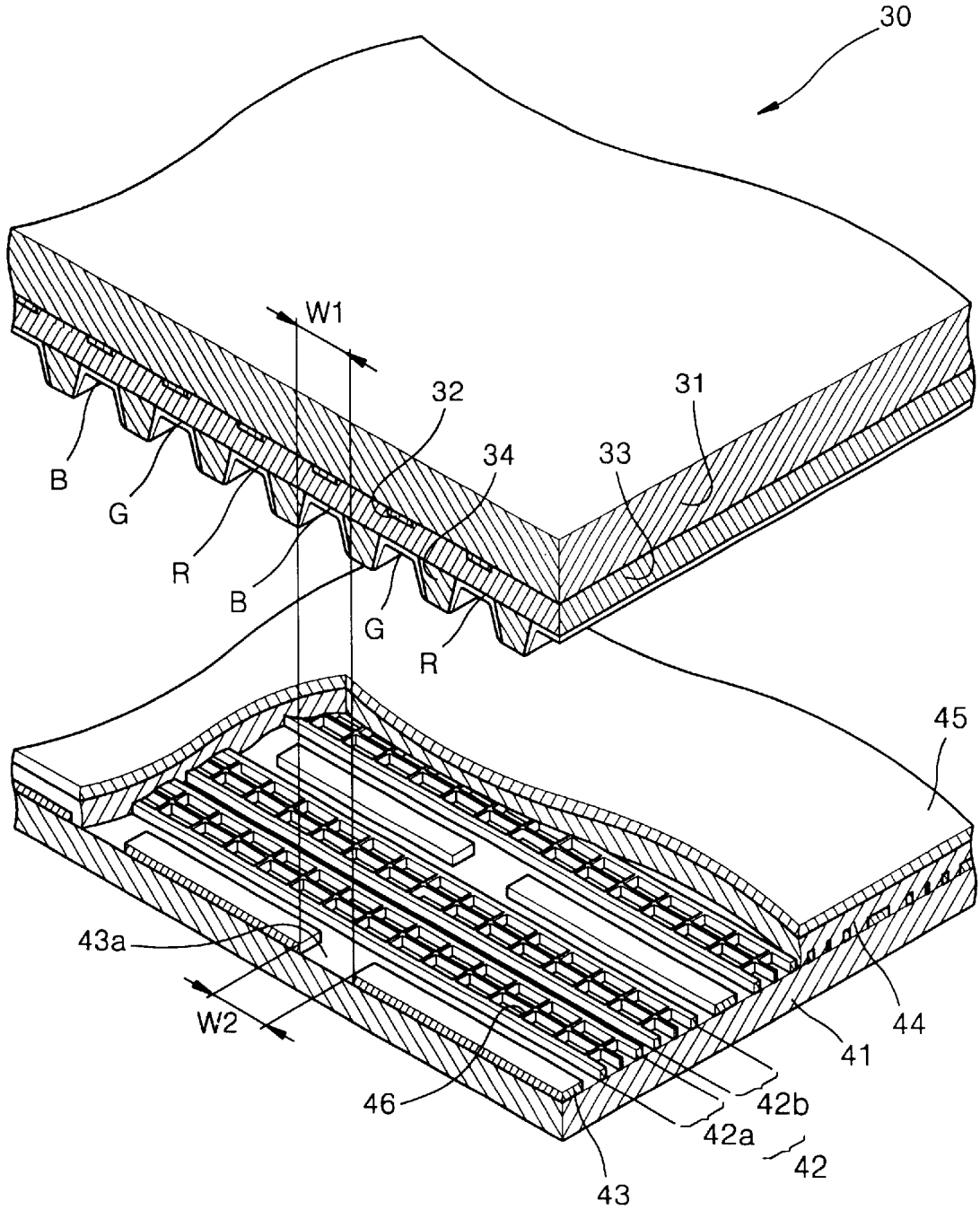
FIG. 5 is an exploded perspective view of a plasma display panel according to yet another embodiment of the present invention.

FIG. 5 shows a plasma display panel according to a third embodiment of the present invention. Here, the same elements having the same functions as those shown in FIG. 2 are indicated by using the same reference numerals.

Referring to FIG. 5, in a plasma display panel according to the third embodiment of the present invention, a plurality of maintaining electrodes 42 each being constituted by a pair of the first and second electrodes 42*a* and 42*b* are formed on the upper surface of the second substrate 41 perpendicular to the address electrodes 32 of the first substrate 31. The first and second electrodes 42*a* and 42*b* of the maintaining electrodes 42 are separated by a predetermined distance from each other and parallel to each other. Each of the first and second electrodes 42*a* and 42*b* is formed of three electrically connected lines. The three lines of the first electrode 42*a* are electrically connected to one another by a plurality of connection electrodes 46. The connection electrodes 46 are preferably formed at a portion of the maintaining electrodes corresponding to the positions of the partitions 34 formed on the first substrate 31. Also, the three lines of the second electrode 42*b* are electrically connected to one another in the same manner. Although each of the first and second electrodes 42*a* and 42*b* is formed of three lines in the present embodiment, the structure of the first and second electrodes are not limited thereto and a variety of line numbers may be possible. For example, each of the first and second electrodes 42*a* and 42*b* may have two lines. Alternatively, the number of lines for each of the first and second electrodes 42*a* and 42*b* may be different with respect to each other. For example, the number of lines of the first electrode 42*a* may be two while the number of lines of the second electrode 42*b* may be three. The first and second electrodes 42*a* and 42*b* forming the maintaining electrode 42 are preferably formed of metal. Accordingly, the bus electrodes 42*c* and 42*d* of the plasma display panel of FIG. 2 do not need to be formed. Descriptions about other elements of the plasma display panel of the present embodiment are omitted since they are substantially the same as those of the plasma display panel of FIG. 2.

In the operation of the plasma display panel having the above structure according to the present invention, first, when a predetermined pulse voltage is applied to the address electrode 32 and one of the first and second electrodes 42*a* and 42*b* which form the maintaining electrode 42, an address discharge is generated therebetween so that wall charges are formed in the inner surfaces of the corresponding discharge space. The generated wall charges are charged within the surface of the second dielectric layer 44.

In this state, when a voltage is applied between the first and second electrodes 42*a* and 42*b* that form the maintaining electrode 42, a maintaining discharge is generated there between and a mother light beam is emitted. Here, a maintaining discharge is generated between the maintaining electrodes 42. An ultraviolet beam is generated from a discharge gas and a discharge space by the maintaining discharge. The ultraviolet beam excites a fluorescent layer and the surface of the discharge space to emit a light beam. Thus, the term "mother light beam" is based on the ultraviolet beam being the source of the light beam emission.

The mother light beam generated by the maintaining discharge excites the fluorescent layer coated on the surfaces of the discharge space to emit light. In this process, since a portion 43*a* of the black matrix 43 corresponding to the B fluorescent layer is discontinued, the B fluorescent layer has a high NA so that the emission of the light beam generated from the B fluorescent layer is less restricted by the corresponding black matrix than that of the lights generated from the R and G fluorescent layers. Note, as stated previously, that the discontinued portion can correspond with a different layer than the blue one, if required. That is, as shown in FIG. 3, the black matrix 43 is formed perpendicular to the lengthwise direction of the B fluorescent layer formed between the partitions 34. Since the black matrix 43 has the discontinued portion 43*a* at a portion corresponding to the B fluorescent layer in this embodiment, the light emission area of the B fluorescent layer is not limited by the black matrix 43. Thus, in the case of forming a discontinued portion at a black matrix as in the present invention, the amount of a blue light beam generated by the B fluorescent layer and transmitted through the second transparent substrate 41 increases with respect to the case of not forming the discontinued portion at the black matrix. As a result, deterioration of the white balance property due to restriction of the light emission brightness of the B fluorescent layer can be prevented.

Figure 6:
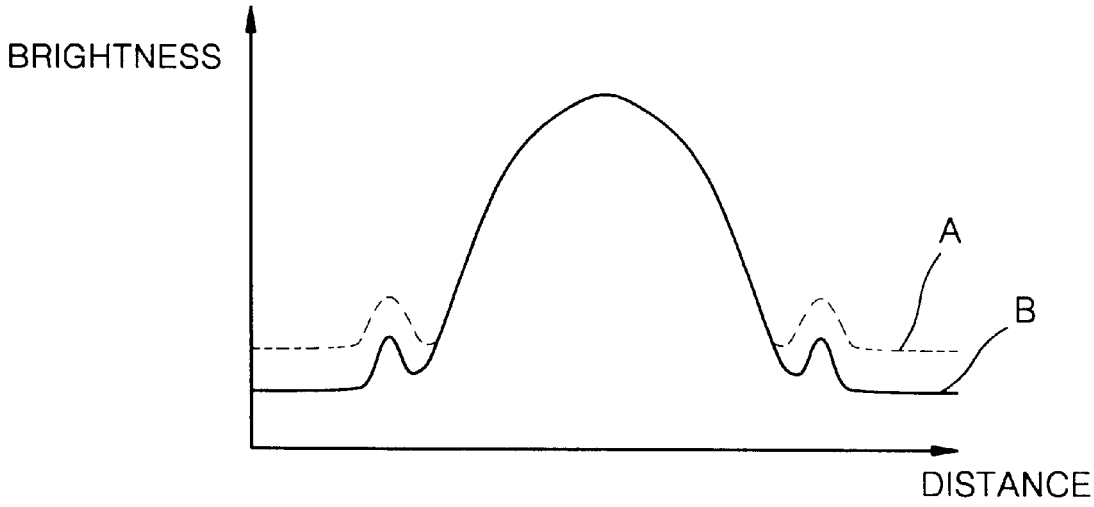
FIG. 6 is a graph showing the relationship in brightness between the conventional plasma display panel and the plasma display panel of the present invention.

According to experiments performed by the inventor, it can be seen that light emission brightness of the blue fluorescent layer where the discontinued portion is formed at the black matrix (graph A) increases as compared to the light emission brightness of the blue fluorescent layer where the discontinued portion is not formed at the black matrix (graph B), as shown in FIG. 6.

As described above, in the plasma display panel according to the present invention, since the discontinued portion is formed at the black matrix which in turn is formed on the second substrate, the NA of the B fluorescent layer area is increased so that restriction of the light emission brightness of the B fluorescent layer can be prevented. Therefore, the white balance property of an image is improved.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A plasma display panel comprising:

first and second substrates facing each other and separated a predetermined distance from each other;

a plurality of address electrodes formed on a surface of the first substrate in a predetermined pattern;

a first dielectric layer covering the address electrodes;

a plurality of maintaining electrodes, each including first and second electrodes, formed on a surface of the second substrate at a predetermined angle with respect to the address electrodes;

a plurality of black matrixes discontinuously and alternately formed between the maintaining electrodes;

a second dielectric layer formed on the second substrate, covering the maintaining electrodes and the black matrixes;

a plurality of partitions formed between the first and second substrates defining discharge spaces; and red, green and blue fluorescent layers coated in the discharge spaces defined by the partitions.

2. The plasma display panel as claimed in claim 1, wherein the first dielectric layer is formed between the partitions.

3. The plasma display panel as claimed in claim 1, wherein the first dielectric layer is formed on the surface of the first substrate and the partitions are formed on a surface of the first dielectric layer opposite to that found on the surface of the first substrate.

4. The plasma display panel as claimed in claim 1, wherein the first and second electrodes of the maintaining electrodes are separated a predetermined distance from each other and each of the first and second electrodes are formed of metal electrodes of at least two lines.

5. The plasma display panel as claimed in claim 4, wherein each of the first and second electrodes of the maintaining electrodes is formed of a metal electrode which is formed of a different number of lines from that of the other one of the first and second electrodes.

6. The plasma display panel as claimed in claim 1, wherein each black matrix is formed such that a portion corresponding to a fluorescent layer having a relatively low brightness among the red, green and blue fluorescent layers is discontinued.

7. The plasma display panel as claimed in claim 6, wherein the fluorescent layer corresponding to the discontinued portion of the black matrix is the blue fluorescent layer.

8. A plasma display panel comprising:

first and second substrates facing each other;

a plurality of address electrodes formed on a surface of the first substrate parallel to each other;

a plurality of maintaining electrodes formed on a surface of the second substrate at a predetermined angle with respect to the address electrodes;

a plurality of partitions formed between the first and second substrates, defining a plurality of discharge spaces;

a plurality of different color fluorescent layers coated respectively coated in the discharge spaces; and a plurality of black matrixes respectively formed in between and parallel to adjacent ones of the maintaining electrodes, each having a discontinuity corresponding to one color of the fluorescent layers.

9. The plasma display panel as claimed in claim 8, wherein the plurality of different color fluorescent layers is red, green and blue fluorescent layers and the one fluorescent layer is the blue flourescent layer.

10. The plasma display panel as claimed in claim 9, wherein a width of the discontinuity is substantially the same as a width of the one color fluorescent layer.

11. The plasma display panel as claimed in claim 8, further comprising:

a first dielectric layer formed on the first substrate, covering the address electrodes and being between the partitions;

a second dielectric layer formed on the second substrate and covering the maintaining electrodes and the black matrixes; and a protective layer formed on the second dielectric layer;

wherein the partitions are formed on a surface of the first dielectric layer opposite to that contacting the surface of the first substrate.

* * * * *